US008061741B2

(12) United States Patent
Chambers

(10) Patent No.: US 8,061,741 B2
(45) Date of Patent: Nov. 22, 2011

(54) MOVABLE BARRIER DRIVE CASE INSTALLATION SAFETY LATCH METHOD AND APPARATUS

(75) Inventor: Christopher Paul Chambers, Auckland (NZ)

(73) Assignee: The Chamberlain Group, Inc., Elmhurst, IL (US)

( * ) Notice: Subject to any disclaimer, the term of this patent is extended or adjusted under 35 U.S.C. 154(b) by 1043 days.

(21) Appl. No.: 11/874,679

(22) Filed: Oct. 18, 2007

(65) Prior Publication Data

US 2009/0100756 A1 Apr. 23, 2009

(51) Int. Cl.
*E05C 21/00* (2006.01)
*E05C 17/44* (2006.01)

(52) U.S. Cl. ..... 292/1; 292/194; 292/202; 292/342; 248/678

(58) Field of Classification Search ..... 292/1, 194, 292/202, 204, 219, 224, 228, 342, DIG. 63, 292/DIG. 36, DIG. 64; 181/209; 248/612, 248/221.11, 222.11, 222.52, 222.31, 223.31, 248/678; 49/197, 199, 394; 403/321, 322.1
See application file for complete search history.

(56) References Cited

U.S. PATENT DOCUMENTS 617,339 A * 1/1899 Johnson ..... 292/224
1,358,611 A * 11/1920 Black ..... 292/342
1,511,336 A * 10/1924 Hoey ..... 248/656
1,743,434 A * 1/1930 Cramer ..... 292/202
2,500,044 A * 3/1950 Riddell ..... 292/202
2,503,370 A * 4/1950 Zanona ..... 292/198
2,765,997 A * 10/1956 Motts ..... 248/657
3,652,044 A * 3/1972 Manross ..... 248/657
3,934,829 A * 1/1976 Coucher ..... 241/259.1
4,191,237 A * 3/1980 Voege ..... 160/188
4,222,508 A * 9/1980 Bott ..... 224/324
4,661,031 A * 4/1987 Heine ..... 411/263
5,975,480 A * 11/1999 Schaefer et al. ..... 248/678
6,450,782 B1 * 9/2002 Sakamoto ..... 417/359

* cited by examiner

*Primary Examiner* — Carlos Lugo
*Assistant Examiner* — Alyson M Merlino
(74) *Attorney, Agent, or Firm* — Fitch Even Tabin & Flannery

(57) ABSTRACT

A movable barrier drive case (300) and a clamp (301) wherein the clamp can be configured and arranged to securely and non-temporarily attached the movable barrier drive case to a mounting channel (100). The movable barrier drive case can be configured and arranged to attach securely and non-temporarily to a movable barrier drive assembly. By these teachings, this movable barrier drive case can further comprise an installation safety latch (402) that is configured and arranged to securely and only temporarily maintain a selected disposition of the movable barrier drive case with respect to the mounting channel during installation of the movable barrier drive case. So configured, the installation safety latch can serve to maintain the movable barrier drive case in an installer's selected position with respect to the mounting channel during installation prior to using the clamp to non-temporarily attach the movable barrier drive case to the mounting channel.

23 Claims, 3 Drawing Sheets

MOVABLE BARRIER DRIVE CASE INSTALLATION SAFETY LATCH METHOD AND APPARATUS

TECHNICAL FIELD

This invention relates generally to movable barrier drives.

BACKGROUND

Movable barriers of various kinds are known in the art. These include, but are not limited to, a wide variety of segmented and one-piece garage doors, rolling shutters, pivoting guard arms, sliding gates, and so forth. In many cases, a movable barrier drive serves as a motive force to cause selective movement of such a barrier between open and closed positions.

Various such movable barrier drives are known in the art. In many cases, such a drive couples to the movable barrier via a drive linkage of choice, such as a chain, a belt, or the like. To operate correctly, of course, such a drive linkage should be suitably taut. This can often mean being neither too loose nor too tight. As installation settings can vary one to the other, properly adjusting this tension often comprises an installation detail that cannot be fully attended to in a factory setting.

In many cases, and particularly where price is a significant concern, achieving a proper adjustment of the drive linkage can comprise achieving a proper placement of the movable drive itself with respect to the movable barrier. Often, however, the installation setting itself renders such placement challenging. For example, it will often be the case that a movable barrier drive must ultimately be securely and non-temporarily attached to a wall or ceiling to complete the installation. It can be necessary, however, to first seek to test, set, and/or adjust the drive linkage prior to making this secure and non-temporary affixment.

This can mean holding the movable barrier drive in the anticipated installation location prior to making the secure and non-temporary attachment. In many cases, this can be difficult to safely and readily achieve by the installer. This can mean, for example, attempting to simply hold the drive in the test position while simultaneously manipulating the drive linkage to assess the corresponding achieved tautness. Such an approach can be fatiguing, prone to error, and even presents some risk of damage to the drive should the installer lose their grip and allow the drive to fall.

As another approach, the installer can simply install the drive in a given location and then test the drive linkage for tautness. Upon determining that the drive linkage is either too loose or too tight, the installer can then uninstall the drive and try a different position. This can be repeated until the installer achieves success. Such an approach can again be fatiguing and again presents some opportunities for the drive to drop and become damaged.

BRIEF DESCRIPTION OF THE DRAWINGS

The above needs are at least partially met through provision of the movable barrier drive case installation safety latch method and apparatus described in the following detailed description, particularly when studied in conjunction with the drawings, wherein.

Figure 1:
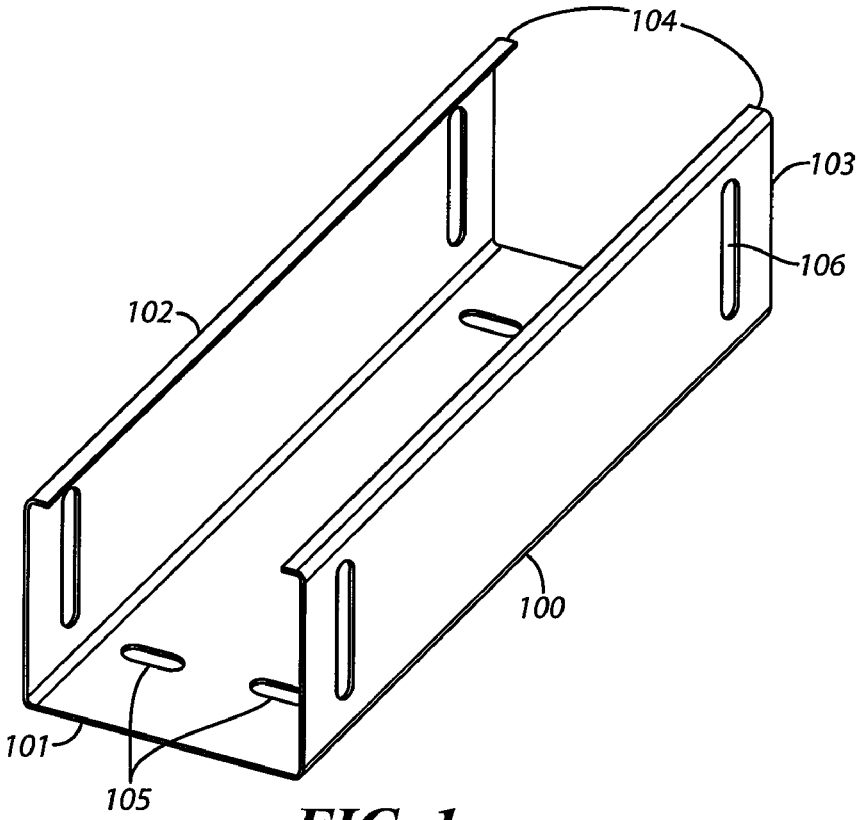
FIG. 1 comprises a perspective view as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Generally speaking, pursuant to these various embodiments, an apparatus can be provided comprising a movable barrier drive case and a clamp. The clamp can be configured and arranged to securely and non-temporarily attach the movable barrier drive case to a mounting channel. The movable barrier drive case can be configured and arranged to attach securely and non-temporarily to a movable barrier drive assembly. By these teachings, this movable barrier drive case can further comprise an installation safety latch that is configured and arranged to securely and only temporarily maintain a selected disposition of the movable barrier drive case with respect to the mounting channel during installation of the movable barrier drive case. So configured, the installation safety latch can serve to maintain the movable barrier drive case in an installer's selected position with respect to the mounting channel during installation prior to using the clamp to non-temporarily attach the movable barrier drive case to the mounting channel.

As used herein, it will be understood that the expression "non-temporarily attach" refers to a duration that may or may not be permanent in the most strict sense of that word, but which is intended and able, for all intents and purposes, to comprise an attachment that, once set, is not unset during subsequent ordinary usage. It will be understood that "non-temporarily attach" can encompass an attachment that is undone when, for example, the complete mechanism is uninstalled. In a similar vein, the word "temporarily" as used in the expression "only temporarily maintain a selected disposition of the movable barrier drive case with respect to the mounting channel during" refers to an attachment that is not intended or able to comprise an ongoing attachment during subsequent ordinary usage.

Accordingly, it will be understood that these references to "temporary" and "non-temporary" are not so much statements regarding duration as they are statements about limitations regarding subsequent usage. In the case of the word "temporary," example, it would be possible for the installation safety latch of these teachings to be used to hold the drive case in a given position with respect to the mounting channel for a significant period of time (such as hours, days, or even weeks) but it would not be possible for this installation safety latch to hold the drive case in this position during ordinary usage of the drive assembly as such usage would likely dislodge the drive case from the mounting channel.

By one approach, these teachings will accommodate the use of more than one such installation safety latch with a given movable barrier drive case. For example, such a case can have two installation safety latches disposed on opposing sides thereof if desired. This installation safety latch can feature, if desired, at least one cam surface that can contact the mounting channel in a way that aids in providing the aforementioned temporary placement. The installation safety latch can further comprise, if desired, a bias member (such as, but not limited to, a leaf spring) that serves to bias the cam surface (or surfaces) against the mounting channel to thereby maintain the movable barrier drive case in the installer's selected position.

So configured, an installer can readily place the movable barrier drive case in a given location along the mounting channel. This position may, or may not, be a suitable location as a non-temporary mounting location. The installation safety latch can serve to easily, readily, and securely temporarily hold the movable barrier drive case in the location to thereby permit the installer to easily assess whether this particular location in fact will well serve as a long term installation position. If not, the installer can easily move the movable barrier drive case with respect to the mounting channel to a new location where the installation safety latch will again temporarily assure that the case remains as positioned while the installer again assesses the suitability of this location. When a suitable location is so divined, the installer can then use the aforementioned clamp to make the non-temporary attachment of the case to the channel.

Figure 2:
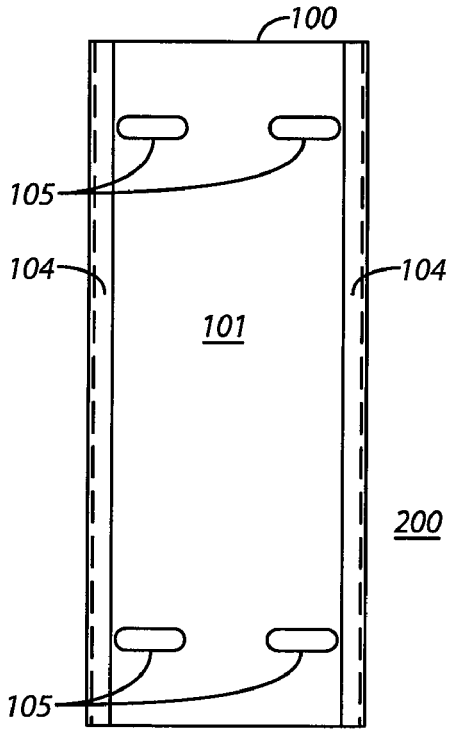
FIG. 2 comprises a front elevational view as configured in accordance with various embodiments of the invention.

These and other benefits may become clearer upon making a thorough review and study of the following detailed description. Referring now to the drawings, and in particular to FIGS. 1 and 2, the aforementioned mounting channel 100 can be comprised of a generally U-shaped member having a base 101 and two opposing sidewalls 102 and 103 disposed on either side of the base 101. This mounting channel 100 can have dimensions that suit the needs of a given intended application setting. As one illustrative example in this regard, this mounting channel 100 can have a length of from between about 15 cm to about 1 meter. As other examples in this regard, the mounting channel 100 can be configured with a relatively narrow width to provide a form factor suitable for mounting on a pillar, beam, or within a narrow recess. The sectional height can be higher than as is suggested in the figures in order to provide displacement away from the mounting surface and to provide more room to enclose a modular attachment such as a manual override mechanism or a clutch module. These teachings will also accommodate a sectional height that is lower than that which is suggested in the figures to accommodate a closer-to-the-wall style of mounting.

This mounting channel 100 serves generally as a point of attachment for the aforementioned movable barrier drive. To aid in this regard, the mounting channel 100 has a plurality of apertures 105 formed in the base 101 to accommodate screws, bolts, nails, or other attachment mechanisms of choice (not shown for the purposes of clarity). So configured, the mounting channel 100 can be readily non-temporarily affixed to a surface 200 of choice (such as a wall, a framing component, or the like).

Those skilled in the art will recognize and appreciate that such a mounting channel 100 can be mounted in any of a wide variety of orientations to suit the needs of a given application setting. By one approach, this can include a substantially vertical orientation such as that illustrated in FIG. 2. By another approach, this can comprise a substantially horizontal orientation. Such a mounting channel 100 can also be affixed to a ceiling or ceiling element such that the open portion of the channel is oriented downwardly if desired.

As illustrated, the sidewalls 102 and 103 of the mounting channel 100 each further comprise an inwardly disposed flange 104. In this particular illustrated embodiment these flanges 104 are fully coextensive with the length of the sidewalls 102 and 103 themselves. If desired, however, it would be possible to provide flanges 104 that are only partially coextensive with these sidewalls 102 and 103. As will perhaps become more clear below, these flanges 104 provide a surface against which the aforementioned installation safety latches are able to act to provide the desired temporarily securement functionality. With this in mind, the width of these flanges 104 can vary with respect to the dimensions and placement of these installation safety latches as will be well understood by those skilled in the art. It would also be possible, in a given application setting, to have these flanges oriented outwardly rather than inwardly (although such a configuration might prompt use of an engagement means different than that which is illustrated as will be understood by those skilled in the art).

By one approach this mounting channel 100 can comprise an integral component wherein the various above-described elements of the mounting channel 100 comprise a single piece. The mounting channel 100 can be comprised of any suitable and useful material as desired. For example, a plastic material might suffice for some application settings. In general, however, the mounting channel 100 may be comprised of a metal of choice, such as but not limited to aluminum, steel, an alloy of choice, and so forth.

As illustrated, one or both of the sidewalls 102 and 103 of the mounting channel 100 can have one or more slot-shaped apertures 106 formed therethrough. These slot-shaped apertures 106 will accommodate, for example, side mounting of the mounting channel 100 to a side wall or to a frame. These apertures 106 will also accommodate alternative orientations for the output shaft (for example, when using a two-part gearcase configuration, the output shaft can be oriented at 90 degrees to "standard," thus effectively making the channel side the mounting front.

Figure 3:
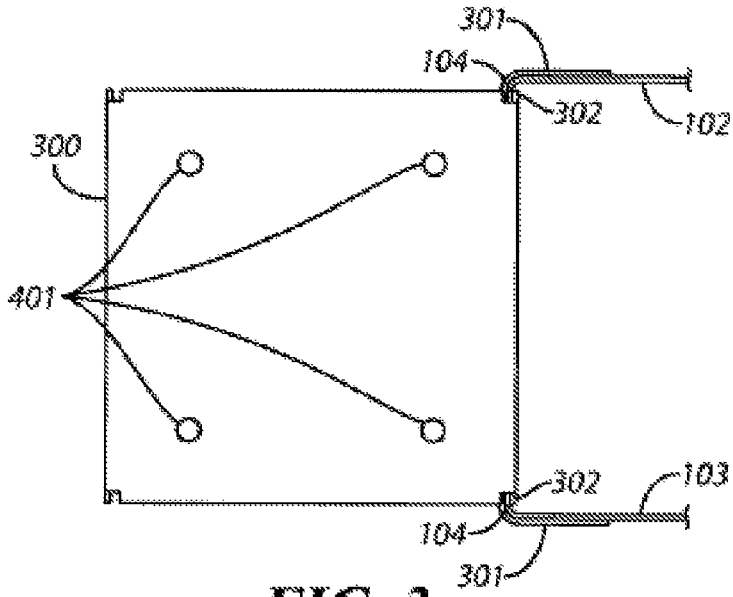
FIG. 3 comprises a top plan view as configured in accordance with various embodiments of the invention.
Figure 7:
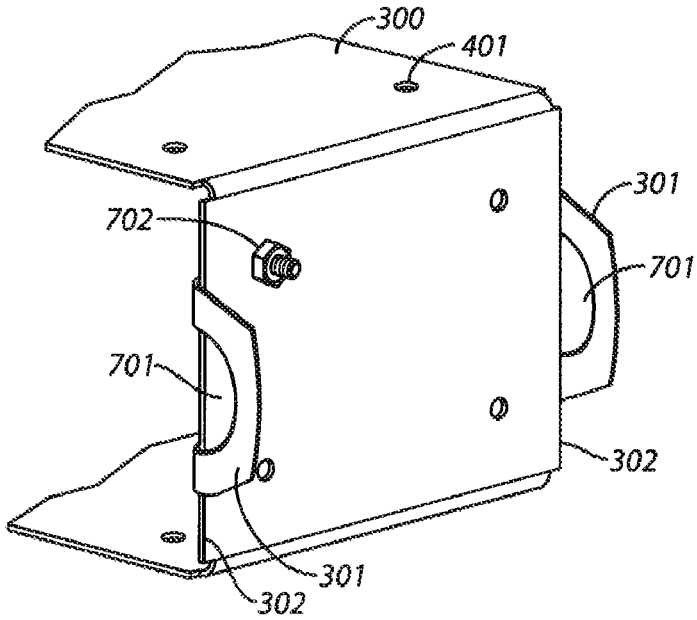
FIG. 7 comprises a detail perspective view as configured in accordance with various embodiments of the invention.

As noted, this mounting channel 100 can serve as a point of affixment for a corresponding movable barrier drive. By one approach as generally illustrated in FIGS. 3 and 7, and without intending any limitations in this regard, this can comprise using a clamp 301 that is configured and arranged to securely and non-temporarily attach a movable barrier drive case 300 to the sidewalls 102 and 103 of the mounting channel 100. Such a clamp 301 can have, if desired, one or more openings 701 formed therethrough to provide access to the aforementioned flanges 104 for the installation safety latch to be described below.

The movable barrier drive case 300 can be secured to the clamp 301 using any attachment mechanism of choice. This can comprise bolts or the like (with one such bolt and a corresponding nut being shown in FIG. 7 as denoted by reference numeral 702), welding, or can even comprise forming these two components as an integral one-piece assembly formed of a shared common material. By one approach, this clamp 301 can be biased inwardly against mounting edges 302 as may be provided on the sides of the movable barrier drive case 300. This can comprise leaving a space between the clamp 301 and these mounting edges 302 of sufficient size to permit the flanges 104 and/or other portions of the sidewalls 102 and 103 of the mounting channel 100 to be readily received therebetween while also ensuring some amount of contact that will serve to tend to temporarily retain these components in a given relative position with respect to one another via mechanical biasing and/or friction.

Figure 4:
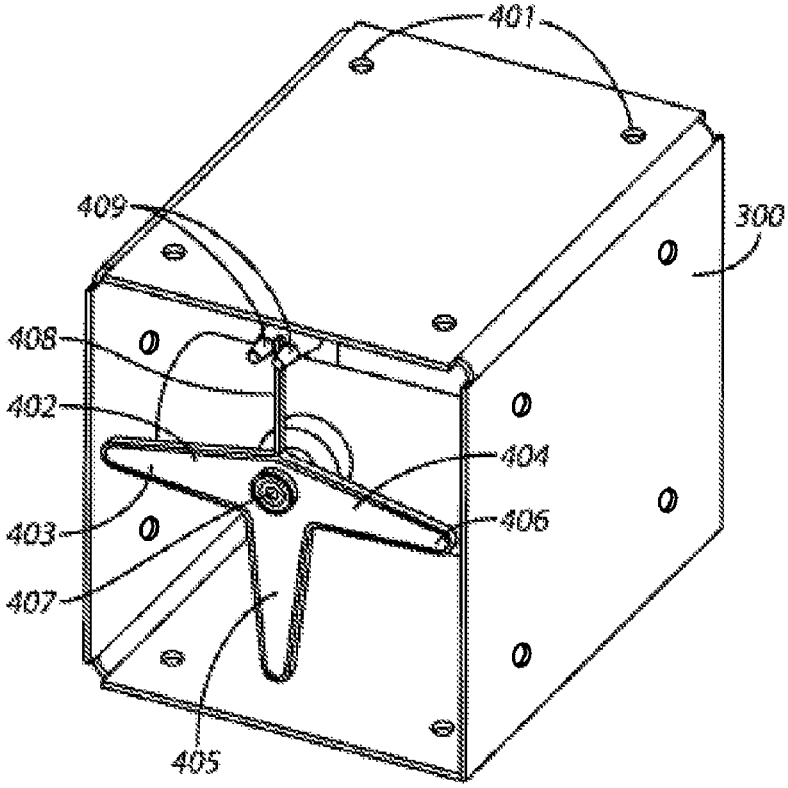
FIG. 4 comprises a perspective view as configured in accordance with various embodiments of the invention.

Referring now to FIG. 4, this movable barrier drive case 300 can itself comprise a boxlike structure comprised of a suitable material (such as plastic or metal) that serves, in this embodiment, to house. By one approach and as illustrated, this movable barrier drive case 300 can comprise one-half of a complete case. By this approach, the illustrated portion can comprise and input and mounting half. Other modules can then attach to the various input faces (using, for example, the apertures 401 as are described further below). These other modules might comprise, for example, a movable barrier motor, a manual override mechanism, and/or a clutch, to note but a few examples in this regard. This movable barrier drive case 300 can also serve to house the input shaft which can be also be connected as required to bevel gears (not shown), thereby allowing the modules mentioned to be connected.

This movable barrier drive case 300, in this embodiment, is configured and arranged to attach securely and non-temporarily to a movable barrier drive assembly (not shown). By one approach, this might comprise forming the latter two components as a common assembly. Or, if desired and as illustrated, this can comprise, for example, providing apertures 401 through which bolts or other affixment members can pass in order to securely couple such components to one another.

This movable barrier drive case 300 has an installation safety latch 402 disposed on a side thereof as shown. If desired, this can also comprise disposing a second such installation safety latch 402 on the opposing side of the movable barrier drive case 300. For the sake of clarity, this second installation safety latch is not shown in the illustration but it will be understood that the description provided herein for the illustrated installation safety latch 402 can apply to the second installation safety latch as well.

Figure 5:
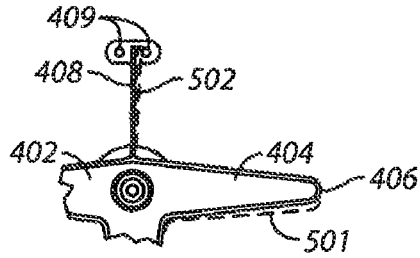
FIG. 5 comprises a side elevational detail view as configured in accordance with various embodiments of the invention.
Figure 6:
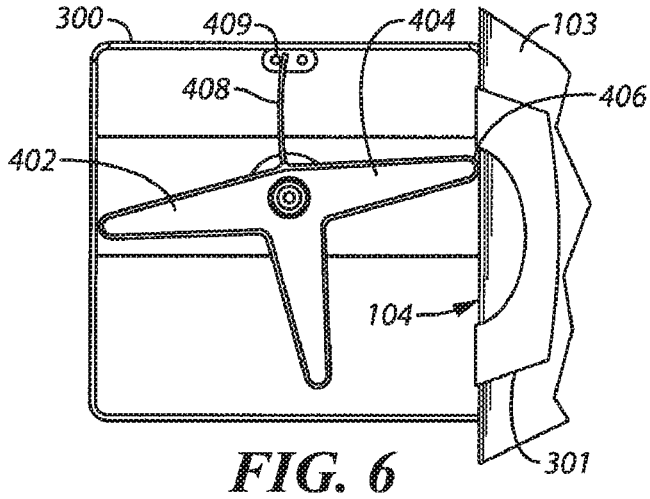
FIG. 6 comprises a side elevational detail view as configured in accordance with various embodiments of the invention.

Referring now to FIGS. 4, 5, and 6, in this embodiment this installation safety latch 402 comprises a plurality of arms 403, 404, and 405 that each serve to form and present at least one movable cam surface 406 on an end thereof. The installation safety latch 402 is configured and arranged to rotate about a pivot point 407 such that the aforementioned arms 403, 404, and 405 are able to relatively freely rotate around an arc in either a clockwise or a counterclockwise manner and thereby interfere with the mounting channel 100 via a non-tangent engagement orientation.

This installation safety latch 402 also includes at least one bias member 408 that serves to bias the at least one cam surface 406 against the mounting channel 100 to thereby maintain the movable barrier drive case 300 in an installer's selected position. This bias member 408 can comprise, as illustrated, a leaf spring though other possibilities are of course possible. A pair of spring stops 409 are affixed with respect to the movable barrier drive case 300 (for example, by affixment thereto) and serve to receive therebetween the bias member 408.

So configured and arranged and as is illustrated in FIG. 5, rotation of the installation safety latch 402 (as caused, for example, by movement of the movable barrier drive case 300 in a withdrawal direction) will eventually be opposed by interaction between the bias member 408 and a corresponding one of the spring stops 409. To illustrate this point, as a first one of the installation safety latch arms 404 moves about an arc via rotation from a first position (shown in solid lines) to a second position (denoted with phantom lines 501), the bias member 408 will also rotate to a position (denoted in phantom lines 502) such that the latter now contacts and opposes one of the spring stops 409.

In this particular embodiment, as the bias member 408 is not absolutely rigid but rather displays some flexible resiliency, continued rotation of the installation safety latch 402 beyond such a point of interference between the bias member 408 and the spring stop 409 is possible. In particular, and referring now specifically to FIG. 6, the installation safety latch 402 can rotate a bit further as the bias member 408 flexes. This flexing, however, provides some additional force upon the cam surface 406 of the installation safety latch arm 406 as it contacts the aforementioned flange 104 of the mounting channel side wall 103.

This additional force, in turn, can serve to temporarily maintain the movable barrier drive case 300 in an installer's selected position with respect to the mounting channel 100 (and in opposition to a withdrawal direction) during installation prior to using the clamp 301 to non-temporarily attach the movable barrier drive case 300 to the mounting channel 100.

The installation safety latch 402 and/or various of its constituent elements can be comprised of metal as desired, but for many application settings plastic material may well readily suffice. As noted, the installation safety latch 402 can be comprised of a plurality of cam surfaces 406. By this approach, and keeping in mind that the movable barrier drive case 300 itself is configured and arranged to permit being selectively attached to the mounting channel 100 in any of a variety of different orientations (including, for examples, orientations that are at least approximately normal to one another), at least one of the plurality of cam surfaces will contact the mounting channel 100 when the movable barrier drive case 300 is disposed against the mounting channel 100 in any of the aforementioned variety of different orientations.

Those skilled in the art will recognize and appreciate that, as configured and arranged, such an installation safety latch 402 can readily serve to provide such a secure albeit temporary means of securing the movable barrier drive case 300 to the mounting channel 100 any number of times. The fundamental action of the installation safety latch 402 is to interact with the mounting channel 100 in a way that tends to hold the movable barrier drive case 300 in opposition to movement in a withdrawal direction unless and until the installer effectively de-actives the installation safety latch 402 by hand (that is, by rotating the latch in an opposing direction to disengage the latch from contact with the mounting channel 100). In particular, by simply moving the movable barrier drive case 300 opposite to the biasing force of the bias member 408, the cam surface 406 (and hence the installation safety latch 402 itself) can be readily moved in an opposite direction to permit detaching the described structure from the mounting channel 100 to thereby permit a similar temporary re-affixment of the movable barrier drive case 300 to a different portion of the mounting channel 100.

This capability, in turn, permits an installer to easily, safely, and effectively test various points of affixment for the movable barrier drive case 300 with respect, for example, to appropriate tautness of the drive linkage (not shown). Those skilled in the art will recognize and appreciate that these benefits are achieved without need to resort to special (or any)

tools, the proverbial "third hand," or the like. It will also be understood that these benefits are readily attained in a generally cost effective manner.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. For example, the fundamental action described herein can be achieved through means other than a cam, provided those means tend to facilitate relative engagement between both the movable barrier drive case and the mounting channel and provided further that those means operate substantially as a function of friction and relative movement as between the moveable barrier drive case and the mounting channel. To illustrate, a racking component and/or a wedging component may serve well in this regard. Generally speaking, such alternative approaches should suffice provided the mechanism of choice is generally symmetrical about a plane that is perpendicular to the plane along which the movable barrier drive case slides (so that the mechanism will work well in at least either of two opposing directions). The mechanism should also preferably serve, through biasing, to permit initial movement of the movable barrier drive case with respect to the mounting channel but that will then accommodate locking and preventing movement in a direction that is opposite to the direction of such initial installation engagement.

I claim:

1. An apparatus comprising:

a movable barrier drive case being configured and arranged to attach securely and non-temporarily to a movable barrier drive assembly; and at least one clamp configured and arranged to securely and non-temporarily attach the movable barrier drive case to a mounting channel;

wherein the movable barrier drive case further comprises an installation safety latch that is configured and arranged to securely and temporarily maintain a selected position of the movable barrier drive case with respect to the mounting channel during installation of the movable barrier drive case wherein the installation safety latch comprises at least one cam surface that contacts the mounting channel;

such that the installation safety latch serves to maintain the movable barrier drive case in an installer's selected position with respect to the mounting channel during installation prior to using the at least one clamp to non-temporarily attach the movable barrier drive case to the mounting channel.

2. The apparatus of claim 1 wherein the movable barrier drive case further comprises a second installation safety latch.

3. The apparatus of claim 2 wherein the two installation safety latches are disposed on opposing sides of the movable barrier drive case.

4. The apparatus of claim 1 wherein the installation safety latch further comprises a bias member that serves to bias the at least one cam surface against the mounting channel to thereby maintain the movable barrier drive case in the installer's selected position.

5. The apparatus of claim 4 wherein the bias member comprises a leaf spring.

6. The apparatus of claim 5 wherein the installation safety latch further comprises at least one spring stop that is configured and arranged to stop the leaf spring to thereby facilitate biasing the at least one cam surface against the mounting channel.

7. The apparatus of claim 1 wherein the installation safety latch is comprised of plastic.

8. The apparatus of claim 1 wherein the movable barrier drive case is configured and arranged to selectively attach to the mounting channel, and wherein the installation safety latch comprises a plurality of cam surfaces such that at least one of the plurality of cam surfaces will contact the mounting channel when the movable barrier drive case is disposed against the mounting channel in any of a variety of different orientations.

9. A method comprising:

providing a movable barrier drive case that is configured and arranged to attach securely and non-temporarily to a movable barrier drive assembly;

providing at least one clamp that is configured and arranged to securely and non-temporarily attach the movable barrier drive case to a mounting channel;

providing the movable barrier drive case with an installation safety latch that is configured to securely and temporarily maintain a selected position of the movable barrier drive case with respect to the mounting channel during installation of the movable barrier drive case, such that the installation safety latch serves to maintain the movable barrier drive case in an installer's selected position with respect to the mounting channel during installation prior to using the at least one clamp to non-temporarily attach the movable barrier drive case to the mounting channel wherein the installation safety latch includes at least one cam surface that contacts the mounting channel.

10. The method of claim 9 wherein the step of providing the movable barrier drive case with an installation safety latch further comprises providing the movable barrier drive case with a second installation safety latch.

11. The method of claim 10 wherein the step of providing the movable barrier drive case with a second installation safety latch comprises providing the movable barrier drive case with two installation safety latches being disposed on opposing sides of the movable barrier drive case.

12. The method of claim 9 wherein the step of providing the movable barrier drive case with an installation safety latch further comprises providing the installation safety latch with a bias member that serves to bias the at least one cam surface against the mounting channel to thereby maintain the movable barrier drive case in the installer's selected position.

13. The method of claim 12 wherein the bias member comprises a leaf spring.

14. The method of claim 13 wherein the step of providing the movable barrier drive case with an installation safety latch further comprises providing the installation safety latch with at least one spring stop that is configured to stop the leaf spring to thereby facilitate biasing the at least one cam surface against the mounting channel.

15. An apparatus comprising:

a movable barrier drive case securely and non-temporarily attachable to a movable barrier drive assembly;

at least one clamp configured to securely and non-temporarily attach the movable drive case to a mounting channel; and wherein the movable barrier drive case further comprises an installation safety latch configured to securely and temporarily maintain the movable barrier drive case in a selected position with respect to the mounting channel prior to non-temporarily securing the at least one clamp to the mounting channel, the installation safety latch comprising at least one cam surface configured to contact the mounting channel to limit relative movement between the movable barrier drive case and the mounting channel prior to using the at least one clamp to non-temporarily attach the movable barrier drive case to the mounting channel.

16. The apparatus of claim 15 wherein the installation safety latch further comprises a bias member that serves to bias the at least one cam surface against the mounting channel to thereby maintain the movable barrier drive case in the selected position.

17. The apparatus of claim 16 wherein the bias member comprises a leaf spring and at least one spring stop configured to stop the leaf spring to thereby facilitate biasing the at least one cam surface against the mounting channel.

18. The apparatus of claim 15 further comprising a second installation safety latch, wherein the two installation safety latches are disposed on opposing sides of the movable barrier drive case.

19. A method comprising:

providing a movable barrier drive case securely and non-temporarily attachable to a movable barrier drive assembly;

providing at least one clamp configured to securely and non-temporarily attach the movable drive case to a mounting channel; and providing the movable barrier drive case with an installation safety latch configured to securely and temporarily maintain the movable barrier drive case in a selected position with respect to the mounting channel during installation prior to non-temporarily securing the at least one clamp to the mounting channel, the installation safety latch comprising at least one cam surface configured to contact the mounting channel to limit relative movement between the movable barrier drive case and the mounting channel prior to using the at least one clamp to non-temporarily attach the movable barrier drive case to the mounting channel.

20. The method of claim 19 wherein the providing the movable barrier drive case with an installation safety latch further comprises providing the installation safety latch with a bias member that serves to bias the at least one cam surface against the mounting channel to thereby maintain the movable barrier drive case in the selected position.

21. The method of claim 20 wherein the bias member comprises a leaf spring and at least one spring stop configured to stop the leaf spring to thereby facilitate biasing the at least one cam surface against the mounting channel.

22. The method of claim 19 wherein the providing the movable barrier drive case with the installation safety latch further comprises providing the movable barrier drive case with a second installation safety latch, wherein the two installation safety latches are disposed on opposing sides of the movable barrier drive case.

23. A method of installing a movable barrier drive case comprising an installation safety latch, the method comprising:

the movable barrier drive case movably engaging a mounting channel, the movable barrier drive case being movable to a selected position with respect to the mounting channel;

contacting the mounting channel with at least one cam surface of the installation safety latch to limit relative movement between the movable barrier drive case and the mounting channel;

biasing the installation safety latch such that the at least one cam surface is biased into contact with the mounting channel with a leaf spring coupled to move with the at least one cam surface, and the leaf spring engaging a spring stop to limit the movement of the installation safety latch;

securely and non-temporarily attaching the movable drive case to the mounting channel with at least one clamp after the movable barrier drive case has been moved to the selected position.

* * * * *